US005572245A

United States Patent [19]

Cowger

[11] Patent Number: 5,572,245

[45] Date of Patent: Nov. 5, 1996

[54] PROTECTIVE COVER APPARATUS FOR AN INK-JET PEN

[75] Inventor: Bruce Cowger, Corvallis, Oreg.

[73] Assignee: Hewlett-Packard Company, Palo Alto, Calif.

[21] Appl. No.: 209,082

[22] Filed: Mar. 10, 1994

[51] Int. Cl.[6] ..... B41J 2/135

[52] U.S. Cl. ..... 347/44; 347/29; 347/87

[58] Field of Search ..... 347/44, 29, 87, 347/30, 31; 220/346, 347, 348, 349; 400/124.31

[56] References Cited

U.S. PATENT DOCUMENTS

| | | | |
|---|---|---|---|
| 3,951,555 | 4/1976 | Wittnebert et al. | 401/217 |
| 4,371,881 | 2/1983 | Bork et al. | 347/44 |
| 4,404,572 | 9/1983 | Okamura et al. | 347/37 |
| 4,432,004 | 2/1984 | Glattli | 347/29 |
| 4,436,439 | 3/1984 | Koto | 347/29 |
| 4,458,255 | 7/1984 | Giles | 347/21 |
| 4,475,116 | 10/1984 | Sicking et al. | 347/86 |
| 4,492,969 | 1/1985 | Terasawa | 347/30 |
| 4,500,894 | 2/1985 | Kirner | 346/140 R |
| 4,503,443 | 3/1985 | Dagna et al. | 347/55 |
| 4,542,389 | 9/1985 | Allen | 347/44 |
| 4,567,494 | 1/1986 | Taylor | 347/30 |
| 4,571,599 | 2/1986 | Rezanka | 347/87 |
| 4,577,200 | 3/1986 | Rix et al. | 347/49 |
| 4,590,495 | 5/1986 | Okamura | 347/85 |
| 4,631,550 | 12/1986 | Piatt et al. | 347/80 |
| 4,631,554 | 12/1986 | Terasawa | 347/30 |
| 4,646,111 | 2/1987 | Shimosato et al. | 347/44 |
| 4,684,963 | 8/1987 | Naka | 347/29 |
| 4,709,245 | 11/1987 | Piatt | 347/49 |
| 4,709,246 | 11/1987 | Piatt et al. | 347/40 |
| 4,709,247 | 11/1987 | Piatt et al. | 347/40 |
| 4,716,920 | 1/1988 | Crute | 137/39 |
| 4,755,836 | 7/1988 | Ta et al. | 347/49 |
| 4,801,951 | 1/1989 | Shimazaki | 347/29 |
| 4,808,021 | 2/1989 | Kelly . | |
| 4,853,717 | 8/1989 | Harmon et al. | 347/29 |
| 4,872,026 | 10/1989 | Rasmussen et al. | 347/56 |
| 4,908,638 | 3/1990 | Albosta et al. | 347/43 |
| 4,926,196 | 5/1990 | Mizoguchi et al. | 347/23 |
| 4,952,947 | 8/1990 | Kyoshima | 347/30 |
| 4,970,535 | 11/1990 | Oswald et al. | 347/25 |
| 5,018,884 | 5/1991 | Hirano et al. | 347/30 |
| 5,027,134 | 6/1991 | Harmon et al. | 347/29 |
| 5,034,758 | 7/1991 | Ebersole et al. | 346/146 |
| 5,051,761 | 9/1991 | Fisher et al. | 347/30 |
| 5,065,169 | 11/1991 | Vincent et al. | 347/8 |
| 5,103,244 | 4/1992 | Gast et al. | 347/33 |
| 5,105,210 | 4/1992 | Hirano et al. | 347/108 |
| 5,115,250 | 5/1992 | Harmon et al. . | |
| 5,146,243 | 9/1992 | English et al. | 347/33 |
| 5,151,715 | 9/1992 | Ward et al. | 347/29 |
| 5,155,497 | 10/1992 | Martin et al. | 347/33 |
| 5,208,610 | 5/1993 | Su et al. | 347/49 |
| 5,221,936 | 6/1993 | Saito et al. | 347/86 |
| 5,363,132 | 11/1994 | Ikkatai | 347/24 |

FOREIGN PATENT DOCUMENTS

| | | | |
|---|---|---|---|
| 0125001 | 3/1984 | European Pat. Off. . | |
| 0379151 | 6/1990 | European Pat. Off. . | |
| 0425254 | 10/1990 | European Pat. Off. . | |
| 61-230945 | 10/1986 | Japan . | |
| 61-255862 | 11/1986 | Japan . | |
| 62-101445 | 5/1987 | Japan . | |
| 62-251145 | 10/1987 | Japan . | |
| 2-78588 | 3/1990 | Japan . | |
| 5112016 | 5/1993 | Japan | 347/44 |

OTHER PUBLICATIONS

IBM Technical Disclosure Bulletin vol. 11 No. 11, "Self-Storing Dust Cover", by J. R. Harp, D. J. Lasher, J. P. Wang and F. Y. Wills, Apr. 1969, p. 1418.

*Primary Examiner*—Benjamin R. Fuller
*Assistant Examiner*—Kevin Saunders

[57] ABSTRACT

An ink pen is provided with a protective cover apparatus to protect the ink pen print head against damage caused by the ingress of dirt and debris, the accumulation of solidification of ink, and the like. The protective cover apparatus has a resilient shield bent in a curve that includes an arch. The shield may be mounted to the ink pen and move between a protective position and a stowed position. In the protective position, the arch is protectively positioned over the print head. In the stowed position, the shield may be retracted into a cavity provided in the ink pen.

19 Claims, 5 Drawing Sheets

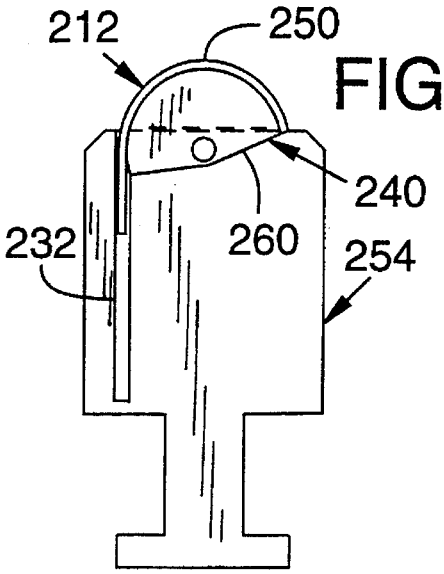
FIG. 9
FIG. 10
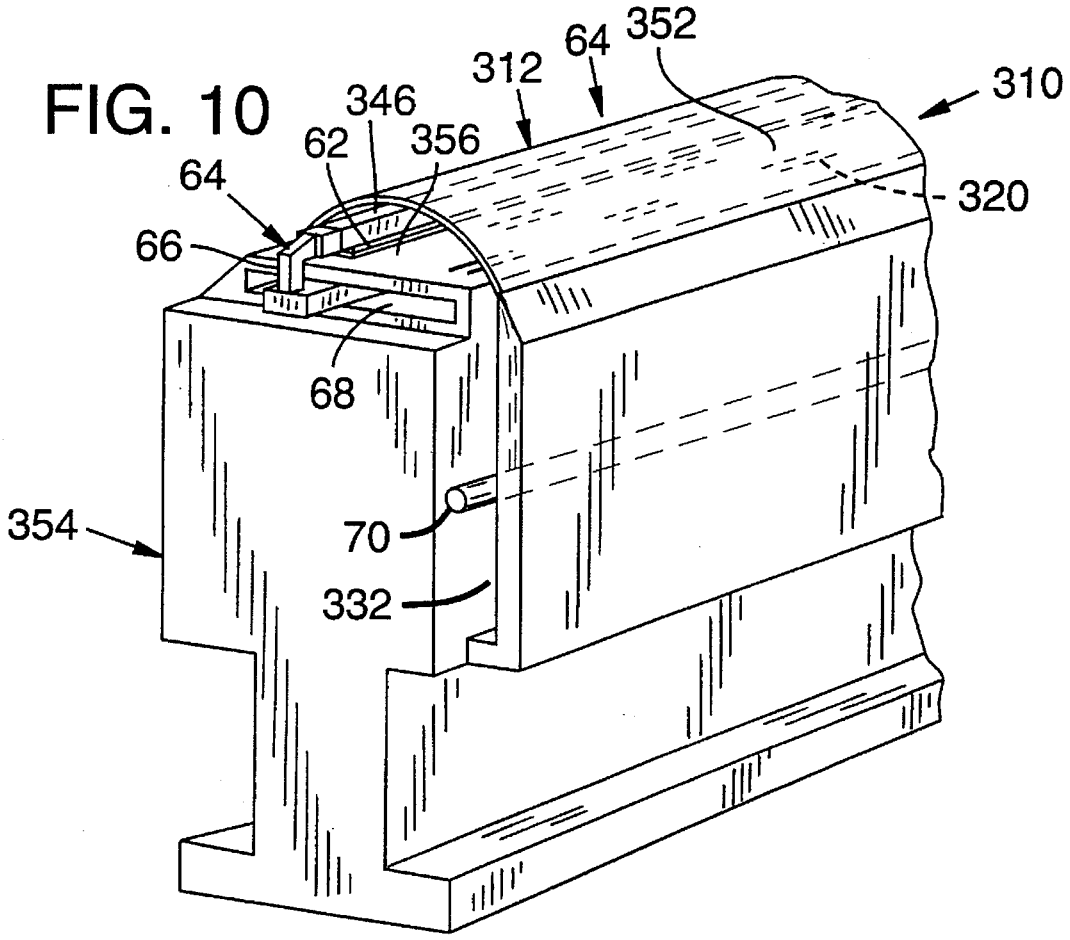

PROTECTIVE COVER APPARATUS FOR AN INK-JET PEN

BACKGROUND INFORMATION

The present invention relates to pens for ink-jet printers and, more particularly to a protective cover apparatus for such pens.

A pen for an ink-jet printer includes a reservoir for containing a supply of ink and a print head having an array of minute orifices that are shaped as nozzles through which ink drops are ejected. Thermal resistors or piezoelectric mechanisms associated with each nozzle are responsive to electrical signals for generating drops that are selectively ejected to form images on paper that is advanced through the printer. When the pen is positioned within a printer carriage, electrical contacts on the pen engage corresponding contacts on the printer carriage to allow electrical connection of the drop generators with the control system of the printer.

Ink pens are replaceable so that when the supply of ink within the reservoir is depleted or the print head malfunctions, the pen can be removed and replaced with a new pen.

Unless protected, the orifices of the print head can become plugged as a result of the accumulation of dust or paper fibers on the print head. Such foreign particles may accumulate on an exposed print head.

Vapor loss may also cause an ink pen to malfunction. Ink is a combination of many different components, some of which evaporate more readily than others. As a result, prolonged exposure of the ink to the ambient atmosphere will cause the evaporation of at least the most readily evaporated components. This evaporation can alter the composition of the ink such that the pen can no longer function properly. In extreme cases, the ink within the orifices may thicken or solidify, thereby plugging the orifices.

To ensure the reliable and efficient operation of an ink-jet pen, it is desirable to protect the print head orifices to the extent practical. The print head of some ink pens may be covered with tape following the manufacture of the pen. The tape serves as a vapor barrier to limit evaporation of the ink and covers the print head to help prevent contamination of the print head during shipment and storage of the ink pen. The tape is removed and discarded prior to placing the ink pen within a printer. As a result, the print head and ink-jets may be left unprotected and without an adequate vapor barrier during the life of the ink pen.

Some ink-jet printers are provided with built-in capping stations. When the ink pen is not printing, the printer moves the ink pen to the capping station where the print head and ink-jets are shielded. However, over time such permanent capping stations can become dirty or wear out. If this occurs, the capping stations no longer perform properly and moving an ink pen to such a capping station may contribute to the contamination of the print head. Furthermore, built-in capping stations may contact the orifices on the print head if either the capping station or the ink pen is slightly misaligned within the printer. Such contact can push paper dust and spattered ink into the orifices, thereby plugging the orifices.

Special storage containers, or ink pen garages, are also available to protect ink pens. However, when an ink pen garage is used for protection, the ink pen must be removed from the printer, placed in the ink pen garage, and then removed from the garage and replaced within the printer for use.

SUMMARY OF THE INVENTION

The present invention provides a protective cover for an ink pen that protects the print head from contact with foreign objects, and from contamination by dust and the like.

This invention also provides a protective cover that maintains a humidified environment for the print head.

A protective cover apparatus for an ink pen in accordance with one aspect of the present invention has a thin shield bent in a curve that includes an arch. The thin shield may be retractably mounted to the ink pen and move between a protective position and an retracted open position. In the protective position, the arch is positioned over the print head to protect the print head from contamination by the ingress of dirt and debris. The arch has a stiffness to protect the print head from contact with the interior of the arch when the ink pen is handled.

In another aspect of the invention, the ink pen has a cavity for stowing the shield. The shield retracts into the cavity when the cover is moved to the open position.

In yet another aspect of the invention, the curve of the thin shield has a coil. The coil is received into the ink pen cavity and is unfurled as the cover is moved into the protective position. The unfurled coil is biased toward furling. Thus, the unwound coil exerts a clock-spring-like force to retract the shield into the cavity, thereby moving the cover into the open stowed position.

Other aspects of the present invention will become apparent to those skilled in the art from the detailed description of the invention, which is presented by way of example and not as a limitation of the present invention.

BRIEF DESCRIPTION OF THE DRAWINGS

FIG. 9 is a side view of the protective cover apparatus of FIG. 7 in the protective position.

FIG. 10 is a partial perspective view showing the bottom and sides of an ink pen having a protective cover apparatus in accordance with another preferred embodiment of the present invention.

DESCRIPTION OF PREFERRED EMBODIMENTS

Figure 1:
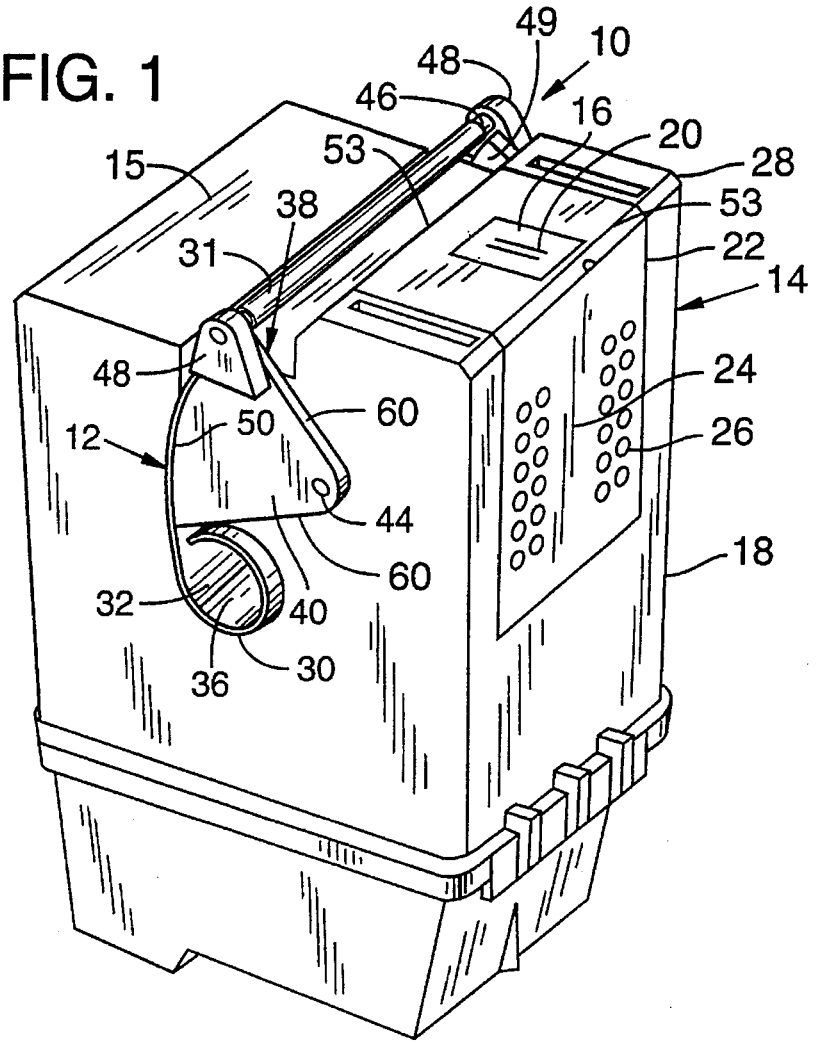
FIG. 1 is a perspective view showing the bottom and sides of an ink pen having a protective cover apparatus in accordance with a preferred embodiment of the present invention.

An ink-jet pen protective cover apparatus in accordance with a preferred embodiment of the present invention is designated in FIG. 1 with reference numeral 10. The illustrated cover includes a thin shield 12 retractably mounted to the bottom 15 of an ink pen 14. The illustrated ink pen 14 (shown inverted for illustrative purposes) has a reservoir 18 for holding a supply of ink. A print head 16 is in fluid communication with the reservoir 18. The print head 16 is provided with an array of ink-jet orifices 20, each of which can be actuated by known means to eject ink drops to form desired characters and images.

The cover 10 can be moved between an open position and a protective position. In the protective position, shown in FIG. 3, the shield 12 covers the print head 16 to shield the orifices 20 from contact during handling and from the ingress of dust, paper fibers, and other contaminants. In this way, the cover 10 minimizes print head damage and orifice clogging.

Referring again to FIG. 1, a flexible-strip conductor 22 extends from the print head 16 and terminates in a contact pad 24, which is fixed to one side of the reservoir 18. The contact pad 24 has an array of exposed electrical contacts 26. The strip conductor contains a number of electrical leads extending from the electrical contacts 26 to drop generators associated with the orifices 20. When the ink pen 14 is positioned within a printer (not shown), these electrical contacts 26 engage corresponding contacts on the printer. In this manner, the control system of the printer can selectively actuate any given ink-jet 20 by providing an electrical signal to the appropriate contact or contacts.

Figure 2:
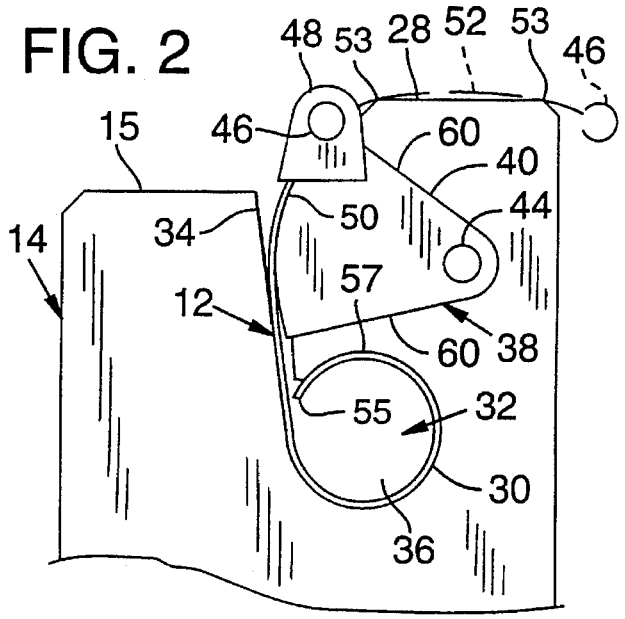
FIG. 2 is a partial side view of the protective cover apparatus of FIG. 1 in an open position, with the closed or protective position of the cover shown in phantom.
Figure 3:
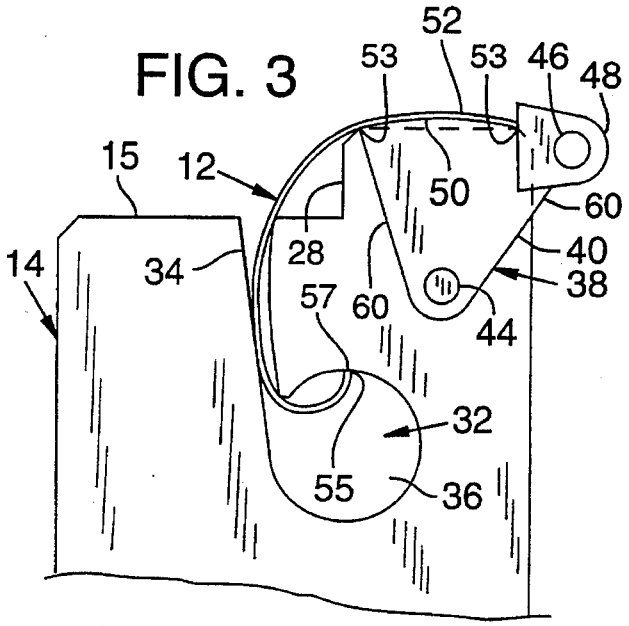
FIG. 3 is a partial side view of the protective cover apparatus of FIG. 1 in the protective position.

In the embodiment illustrated in FIGS. 1, 2 and 3, the print head 16 is mounted on a support platform 28 that extends from the bottom 15 of the ink pen 14. The shield 12 is a thin, rectangular piece of material—in this case, stainless steel—that is bent to normally assume a curved shape. The shield 12 is bent into an overlapping cylindrical coil, as explained below.

As seen in FIG. 2, a cavity 32 formed in the ink pen 14 receives one end 30 of the coiled shield. In the illustrated embodiment, the cavity 32 has a cross-section shaped generally like the numeral "6". The stem 34 of the "6"-shaped cavity 32 is contiguous with the cylindrical portion 36 of the cavity 32 and opens to the bottom 15 of the ink pen near the support platform 28. The cylindrical portion 36 receives the shield end 30.

An outer end 31 of the shield 12 protrudes from the cavity stem 34. The shield end 31 is attached to an axle-like bail 46 that extends between a pair of pivot arms 38. As shown in FIGS. 1–3, the pivot arms 38 may be rigid, sector-shaped members ("sectors") 40 with two straight radial edges 60 and an arcuate edge 50. Each sector 40 has an aperture formed adjacent the intersection of the two radial edges 60. The apertures receive pivot posts 44 that extend laterally from each opposing side of the reservoir 18 near the support platform 28, thereby permitting the bail 46 to swing over the platform 28.

FIGS. 1 and 2 show the cover 10 in the open position where the print head 16 is exposed for printing. In the open position, the sectors 40 are pivoted sideways, with one corner 49 of each sector 40 protruding from the plane of the ink pen bottom 15 (see FIG. 1). The bail 46 is attached to the sector members 40 at bail anchors 48 that are attached to extend from each corner 49 of each sector 40. In a preferred embodiment, bail anchor holes receive the bail 46. Heat staking may be used to mushroom and permanently attach the ends of the bail 46 to the anchors 48.

In a preferred embodiment, the end 31 of the shield 12 is attached to the bail 46 by being looped around the bail 46 and compression-welded onto itself. It is be appreciated that the attachment may also be accomplished in other ways, including spot welding, adhesives, riveting, or use of other fasteners. Moreover, the shield end 31 can be attached directly to the bail 46 using any of a variety of attachment means.

FIG. 3 (and the phantom lines in FIG. 2) shows the cover 10 in the closed or protective position. To arrive at this position, the sectors 40 are pivoted about the posts 44 so that the coiled shield unfurls from the cavity 32 to cover the print head 16. The cover may be moved to the protective position manually or by an actuator mechanism.

In the protective position, the arcuate edge 50 of each sector member 40 supports the shield 12 over the print head 16. The arcuate edge 50 helps define an arch 52 in the curve of the shield 12. The shield arch 52, curved as it is about an axis generally parallel to that of posts 44, is hereby stiffened to resist flexing. The arch 52 also provides excellent stiffness when the arch curvature is not purely arcuate.

It has been found that a shield arch of about 0.1 millimeter thick stainless steel at least ¾ hard can be freely handled without substantial deflection of the arch 52. A cover with such a shield 12 provides excellent protection for the print head 16 during shipping and storage.

The shield may be attached only at one point or along one portion of the arcuate edge 50. Such attachment permits the shield to lift off from the arcuate edge 50 when the cover 10 is in the open position. The shield 12 may alternatively be attached along the entire length of the arcuate edge 50. In the embodiment of FIGS. 1–3, such attachment along the entire arcuate edge 50 may require either a wider or correspondingly curved cavity stem portion 34.

The shield embodiment of FIGS. 1–3 provides its own retraction force to move the cover 10 from the protective to the retracted open position. The abovenoted bending of the shield into the coiled shape biases the shield 12 toward the coiled configuration. Thus, the unfurling of the coil 30 as the cover 10 moves to the protective position creates clock-spring-like stresses in the shield tending to retract the shield 12 into the cavity 32 so that the cover 10 will automatically move to the open position.

The protective cover 10 shown in FIGS. 1–3 may be secured in the protective or closed position in a variety of ways. For instance, detents in the sectors can mate with depressions in the pen body.

The embodiment of FIGS. 1–3 is further advantageous in that a vapor barrier is formed around the print head when the cover 10 is in the protective position. The shield arch 52 substantially seals upon the sector arcuate edges 50 and upon both longitudinal edges 53 of the support platform (see FIG. 3). The arch 52, sectors 40 and covered part of the platform 28 define a small chamber to maintain sufficient humidity in the vicinity of the print head to prevent ink within the orifices 20 from evaporating or solidifying.

Various features of the embodiment of FIGS. 1–3 can be changed while remaining within the scope of the invention. For instance, the coiled inner end 30 of the shield is not attached to the wall of the cavity 32 in the illustrated embodiment (compare FIGS. 2 and 3). It is to be understood, however, that the end may be attached to the wall of the cavity cylindrical portion 36 and provide equally good retraction bias.

It is also to be understood that the cavity stem portion 34 may be shortened or dispensed with. For instance, the cylindrical portion 36 of the cavity may open directly to the bottom 15 of the ink pen. For instance, the cavity may have a cross-sectional shape of an incomplete circle with a flat chord surface. The chord represents the opening of the cavity onto the ink pen bottom. The diameter of the unfurled end 30 may be greater than the width of the cavity opening to provide retention of the shield within the cavity. So configured, the coil can bear upon the cavity wall adjacent the opening to retract the shield from the protective position to the furled, open position.

Moreover, the shape of the cavity 32 may also be varied in several equally effective ways. The cylindrical configuration of the cavity of any of the above-described embodiments may be modified to any shape that retains the shield end 30 without impeding the unfurling or refurling of the coil 30. This includes oversized cavities larger than the diameter of the coiled end 30. Whatever cavity configuration is used, a cavity wall surface must be provided on which the shield coil 30 may exert force to stabilize and refurl the coil. In the case of the embodiment of FIGS. 1–3, the outermost end 55 of the coiled shield end 30 bears against a portion 57 of the cavity wall closest to the ink pen bottom 15.

It is also to be understood that the shield coil 30 may be biased toward unfurling, thus urging the cover 10 into the protective position. This embodiment also has several possible variations. In one, an end of the shield may be attached to the cavity wall and the shield looped around to extend out of the cavity. This embodiment may be understood by imagining that the shield 12 in FIG. 3 were attached to the cavity wall at the portion 57. As the shield is forced into the cavity in the open position, the shield loop would expand within the cavity and develop bending stresses. The bias of the expanded loop toward the unexpanded condition may automatically move the cover to the protective position.

In another possibility, the shield end may extend unattached into a circular cavity. The shield is relatively unstressed when the cover is in the protective position. As the cover moves into the open position, the shield is forced to slide along the cavity wall to be forced into a loop or coil conforming to the wall of the circular cavity. The elastic bending stresses created thereby in the shield provide a cover bias toward the protective position.

Figure 4:
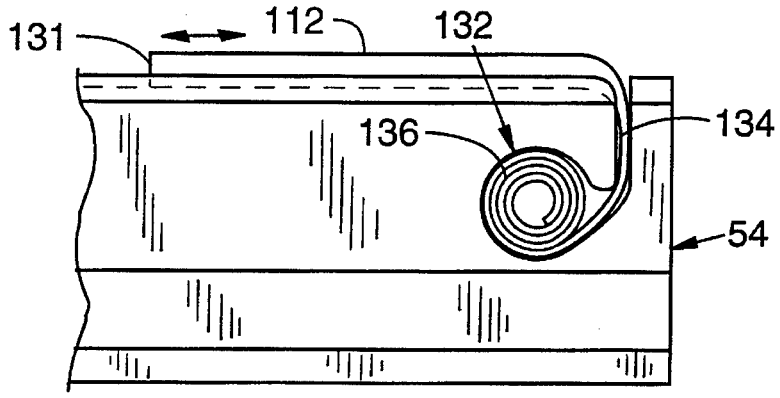
FIG. 4 is a side view showing a wide ink pen having a protective cover apparatus in accordance with another preferred embodiment of the present invention.
Figure 5:
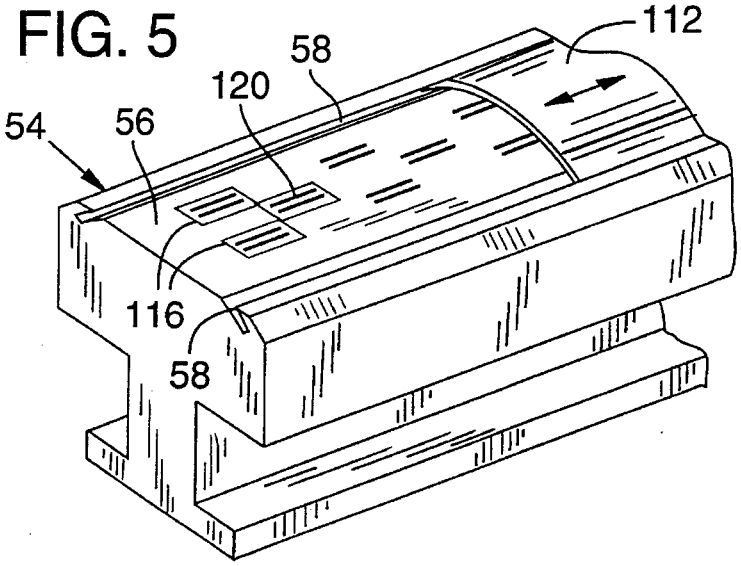
FIG. 5 is partial perspective view showing the bottom and sides of an ink pen having the protective cover apparatus of FIG. 4.
Figure 6:
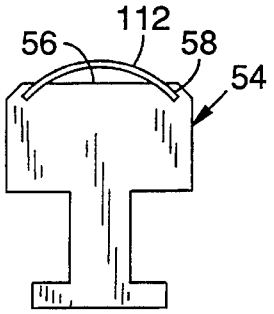
FIG. 6 is a end view of the protective cover apparatus of FIG. 4.

In the cover embodiment of FIGS. 4–6, a shield 112 is arched over a wide pen 54 with a front surface 56 that carries a number of print heads 116. The construction of the wide pen including the technique for supplying ink to the multiple print heads forms no part of this invention, except that the pen 54 has a body that defines a pair of grooves 58 that receive the side edges of the shield 112. A shield 112 is slidable between a protective position wherein it is arched over the front surface 56, and an open retracted position wherein the front surface 56 is exposed. The grooves 58 on either side of the print heads 116 on the front surface 56 slidably receive the opposite side edges of the arched shield 112.

As seen in FIG. 4, the shield 112 may retract into a cavity 132 formed in one end of the wide pen 54. The cavity 132 may have a cylindrical portion 136 and a stem portion 134 that opens to the pen front surface 56. The shield 112 is bent into a spiral coil that is received in the cylindrical portion 136. A shield end 131 extends from the stem portion 134 and is received in the pair of grooves 58. When moved from the protective to the open position, the shield 112 retracts like a tape measure into the cavity 132.

The shield 112 may be manually slid between the protective and retracted positions. A variety of actuator devices (not shown) may also be used to engage and move the shield 112. One actuator device may comprise pins extending from the end of the arched shield 112. A movable yoke engages the pins to open and close the shield 112. The yoke may be actuated by an electric motor via a rack-and-pinion linkage. Alternatively, the arched shield **12*a*** may slide from the protective position to be stowed somewhere in the printer during printing.

Figure 7:
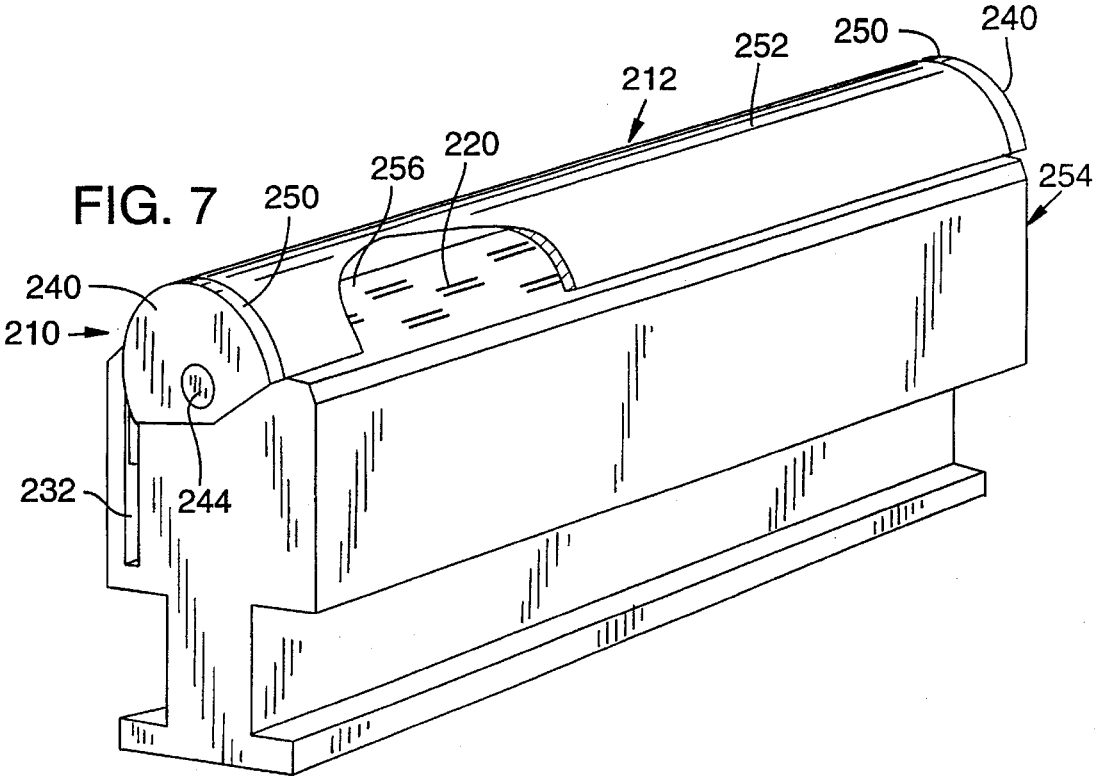
FIG. 7 is a partially cut-away perspective view showing the bottom and sides of an ink pen having a protective cover apparatus in the protective position in accordance with another preferred embodiment of the present invention.
Figure 8:
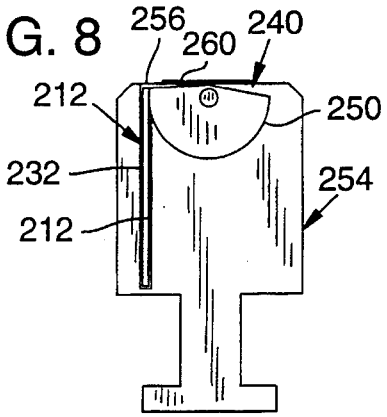
FIG. 8 is a side view of the protective cover apparatus of FIG. 7 in the open position.

Another embodiment of a protective cover 210 for a wide pen 254 is shown in FIGS. 7–9. This embodiment is similar to the embodiment of FIGS. 1–3 in that a pair of sectors 240 with arcuate edges 250 supports a shield 212 over the front surface 256 of the wide pen 254. The sectors 240 pivot upon posts 244 that extend from opposite longitudinal ends of the wide pen 254. In the protective position, the arcuate edges 250 support the shield 212 in an arch 252 over the front surface 256 of the wide pen 254. The arch 252, sectors 240 and covered part of the front surface 256 form a small chamber to maintain sufficient humidity near the orifices 220.

The shield 212 is retracted into a slot-like cavity 232 when the cover 210 moves into the stowed position. As seen in FIG. 8, the shield 212 is attached to the sector 240 only at the intersection of the arcuate edge 250 with a radial edge 260. Such attachment permits the shield 212 to lift off the arcuate edge 250 for retraction into the slot-like cavity 232. The protective cover 210 may be manually moved between the protective and open positions. An actuator may also be provided to engage the sector radial surfaces **60*b* to rotate the sectors 240. Such an actuator (not shown) may comprise pins extending from the sectors 240. A rotatable yoke engages the pins to rotate the sectors 240, thereby opening or closing the cover 210**. The yoke may be actuated by an electric motor via a rack-and-pinion linkage.

Figure 11:
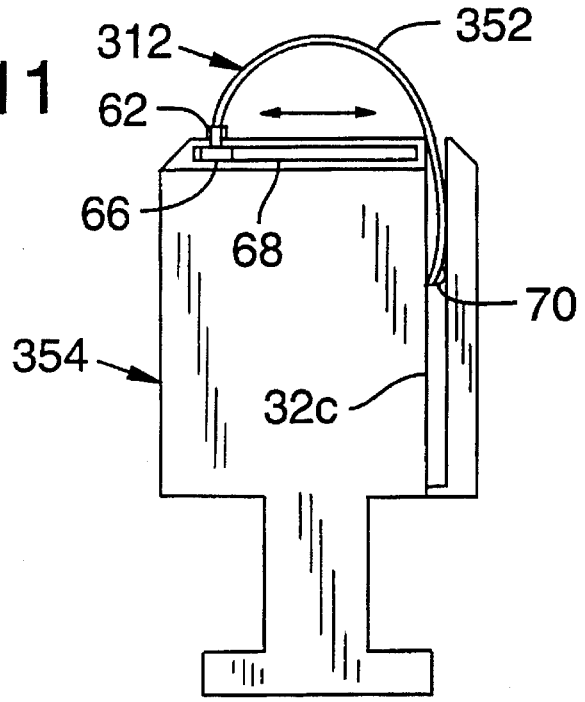
FIG. 11 is a side view of the protective cover apparatus of FIG. 10 in a protective position.
Figure 12:
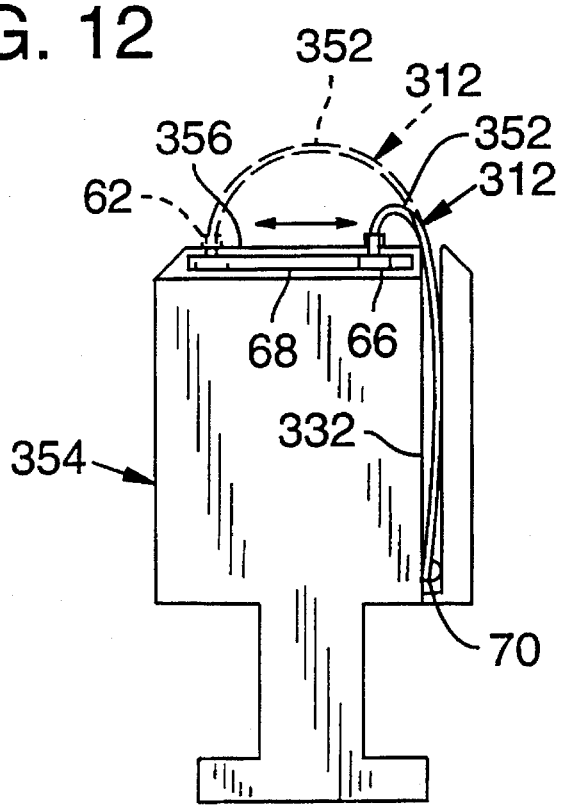
FIG. 12 is a side view of the protective cover apparatus of FIG. 10 in an open position.

FIGS. 10–12 show yet another preferred embodiment of a cover 310 device of the present invention for a wide pen 354. In this embodiment, an elongated bail 346 extends longitudinally across the front surface 356 of the wide pen 354. A shield 312 has one edge attached to the bail 346. A wiper member 62 extends from the bottom of the bail 346 to contact the front surface 356.

As best seen in FIG. 10, the bail 346 may be slidably attached to the wide pen 354 with a foot-in-groove mechanism 64. A foot 66 extends from each end of the wiper member 62 and is received into one of the grooves 68 located in opposite ends of the wide pen 354.

As best seen in FIG. 11, the shield 312 extends generally vertically from the bail 346, arches over the front surface 356, and is received into a slot-like cavity 332 in the wide pen 354. In the protective position, the wiper member 62 is positioned on the front surface 356 across the orifices 320 from the cavity 332 (see FIG. 10).

A position rod 70 is attached along the edge of the shield 312 that is disposed within the cavity 332. The position rod 70 is moved within the cavity to move the shield 312 between the protective and stowed positions. For instance, the position rod 70 shown in FIG. 10 may be pushed (retracted) deeper into the cavity 332 to move the cover 310 from the protective position to the stowed position. As the shield 312 is retracted into the cavity 332, the wiper member 62 wipes across the front surface 56 to clean the orifices 320, and the radius of curvature of the shield arch 352 decreases.

To move the shield into the protective position, the position rod 70 is moved to a shallower position within the cavity 332 (see FIG. 11). Accordingly, the wiper member wipes back across the front surface 356, and the protective shield arch 352 is restored over the front surface 356. When the cover 310 is in the protective position, the position rod 70 is held stationary by friction or detents so that the shield 312 will not retract during handling of the wide pen 354.

It is to be understood that the attachment of the shield 312 to the wiper member 62 can be accomplished in a variety of ways, including compression welding, spot welding, adhesives, riveting, or the use of other fasteners. It is further to be understood that the cavity of this embodiment may be modified to receive a coiled shield. In this way, the cover could be biased toward the open position.

While the shields 12, 112, 212, and 312 of all the illustrated embodiments are preferably made of a stainless steel, it is to be understood that the shield may be made from a variety of materials. For instance, a high-molecular weight plastic, such as polyamide, may be used. Other metals, composite materials, and plastics may be used with equally good results.

This detailed description is set forth only for purposes of illustrating examples of the present invention and should not be considered to limit the invention in any way. Clearly, numerous additions, substitutions, and modifications can be made to these examples without departing from the scope of the invention, which is defined by the appended claims and their equivalents.

The claimed invention is:

1. A protective cover for an ink pen that has a print head comprising:

a resiliently bendable shield, the shield adapted to resiliently bend in a curve that defines an arch, the shield mounted to the ink pen and movable from a stowed position wherein the shield is spaced from the print head to expose the print head, to a protective position wherein the arch of the shield covers the print head to protect the print head against mechanical damage, the resiliency of the shield establishing different shield shapes in the stowed and protective positions; and a cavity formed in the ink pen for accepting at least part of the shield which is retracted into the cavity when the shield is moved to the stowed position.

2. The protective cover of claim 1, further comprising:

a pair of pivot arms interconnecting the ink pen and the shield, the pivot arms pivotally mounted to the ink pen and supporting the shield to guide the shield between the stowed and protective positions.

3. The protective cover of claim 2, wherein the shield connects to a bail interconnecting the pivot arms, the bail moving over the print head as the shield moves between the stowed and protective positions.

4. The protective cover of claim 2 wherein the pivot arms each have a an edge that supports the arch of the shield when in the protective position, the pivot arm edges defining the curvature of the arch.

5. The protective cover of claim 4 wherein the pivot arms have arcuate edges, the arcuate edges supporting the arch of the shield when in the protective position, the arch of the shield sealing against the arcuate edges so that a vapor barrier is formed around the print head when the shield is in the protective position.

6. The protective cover of claim 5 wherein the shield is attached to each pivot arm at a single point along the arcuate edge.

7. The protective cover of claim 6 wherein the cavity is a slot.

8. The protective cover of claim 1 wherein the curve of the shield defines a coil, the coil being received into the cavity, the coil having an unfurled configuration when in the protective position, the coil being unfurled from the cavity when the shield moves to the protective position, the coil in the unfurled configuration biased toward furling thereby to retract the shield into the cavity to move the shield into the stowed position.

9. The protective cover of claim 8 wherein the cavity is defined by a cavity wall, and the coil is unattached to the cavity wall.

10. The protective cover of claim 8 wherein the cavity is defined by a cavity wall, and the coil is fastened to the cavity wall.

11. The protective cover of claim 1, further comprising:

a bail, the bail being connected to the shield and slidably connected to the ink pen; and a wiper member being attached to the bail to wipe across the print head as the shield moves between the stowed and protective positions.

12. A protective cover for an ink pen that has a print head comprising:

a resiliently bendable shield, the shield adapted to resiliently bend in a curve that defines an arch, the shield mounted to the ink pen and movable from a stowed position wherein the shield is spaced from the print head to expose the print head, to a protective position wherein the arch of the shield covers the print head to protect the print head against mechanical damage, the resiliency of the shield establishing different shield shapes in the stowed and protective positions; and a pair of grooves formed in the ink pen for receiving the shield within the grooves whereby the shield is slideable in the grooves between the stowed and protective positions.

13. A system for protecting an ink pen having a print head comprising:

a shield, the shield adapted to bend in a curve that defines an arch, the shield attached to the ink pen and movable between a protective position wherein the arch shields the print head to protect the print head against mechanical damage and a stowed position wherein the shield is spaced from the print head to expose the print head; and a cavity defined within the ink pen for receiving the shield, the shield retracting into the cavity when the shield is in the stowed position.

14. The system of claim 13 wherein:

the curve of the shield defines a coil, the coil being received into the cavity, the coil unfurling when the shield moves to the protective position, the unfurled coil biased toward furling thereby to retract the shield into the cavity to move the shield into the stowed position; and a bail connected to one end of the shield, the bail moving over the print head as the shield moves between the protective and stowed positions.

15. A protective cover for an ink pen having a print head comprising:

a resiliently bendable shield, the shield formed to resile in a curved shape, the shield attached to the ink pen and movable between a stowed position wherein the shield is spaced from the print head to expose the print head and a protective position wherein the shield covers the print head to protect the print head against mechanical damage, the shield having a first shape in the protective position and different second shape in the stowed position.

16. The protective cover of claim 15, further comprising a pair of pivot arms that pivot on opposing sides of the ink pen, the pivot arms being interconnected by the bail and having arcuate edges that support the shield in the protective position, the arcuate edges defining an arched portion of the shield located over the print head.

17. The protective cover of claim 15, further comprising a bail attached to one end of the shield, the bail moving over the print head as the shield moves between the stowed and protective positions.

18. The protective cover of claim 17, wherein the bail is slidably attached to the ink pen to slide over the print head when the cover moves between the stowed and protective positions; and a wiper member extending from the bail to wipe across the print head when the cover moves between the stowed and protective positions.

19. The protective cover of claim 17, further comprising:

a cavity formed within the ink pen for receiving the shield, the shield being retracted into the cavity when in the stowed position; and a rod being attached to a portion of the shield positioned within the cavity in the stowed and the protective positions, the rod being movable within the cavity to move the cover between the protective and stowed positions.

* * * * *